US010349690B2

(12) United States Patent
Francisco Costa et al.

(10) Patent No.: US 10,349,690 B2
(45) Date of Patent: Jul. 16, 2019

(54) SUPPORTED GLOVE HAVING GRIP FEATURES

(71) Applicant: Ansell Limited, Richmond, Victoria (AU)

(72) Inventors: Marco Antonio Francisco Costa, Vila Nova de Poiares (PT); Geraldo Alexandre Pimentel de Oliveira, Coimbra (PT); Paulo Alexandre Goncalves Francisco, Vila Nova de Poiares (PT); Maria Ines Quaresma Ribeiro Campos, Vila Nova de Poiares (PT)

(73) Assignee: Ansell Limited, Victoria (AU)

( * ) Notice: Subject to any disclaimer, the term of this patent is extended or adjusted under 35 U.S.C. 154(b) by 885 days.

(21) Appl. No.: 14/551,780

(22) Filed: Nov. 24, 2014

(65) Prior Publication Data

US 2015/0143609 A1 May 28, 2015

Related U.S. Application Data

(60) Provisional application No. 61/908,576, filed on Nov. 25, 2013.

(51) Int. Cl.
*A41D 19/00* (2006.01)
*A41D 19/015* (2006.01)

(52) U.S. Cl.
CPC ... *A41D 19/01547* (2013.01); *A41D 19/0006* (2013.01)

(58) Field of Classification Search
CPC ..... A41D 19/0006; A41D 19/00; A41D 19/01523; A61B 42/00; G11B 5/3113; G11B 5/3919
See application file for complete search history.

(56) References Cited

U.S. PATENT DOCUMENTS 5,925,441 A * 7/1999 Blauer ..... A41D 19/0006 112/402
5,948,707 A * 9/1999 Crawley ..... A41D 31/02 428/422

(Continued)

FOREIGN PATENT DOCUMENTS

EP 2644044 A1 10/2013
GB 2208348 A 3/1989

(Continued)

OTHER PUBLICATIONS

Extended European Search Report dated Jul. 7, 2017 for application 14864095.6.

(Continued)

*Primary Examiner* — Arti Singh-Pandey
(74) *Attorney, Agent, or Firm* — Moser Taboada

(57) ABSTRACT

Gloves including a fabric liner; a first polymeric composition adhered to at least a portion of the fabric liner, forming a polymeric coating; and a plurality of raised features comprising a second polymeric composition disposed on a surface of the polymeric coating, wherein the polymeric coating and the plurality of raised features comprise different polymeric compositions adapted to enhance at least one of oil grip properties, dry grip properties, or wet grip properties, and methods of making the gloves, are disclosed.

13 Claims, 4 Drawing Sheets

(56) References Cited

U.S. PATENT DOCUMENTS 6,155,084 A * 12/2000 Andrews ..... A41D 13/08 2/16
6,254,947 B1 7/2001 Schaller
6,372,323 B1 * 4/2002 Kobe ..... A63B 49/08 24/442
6,610,382 B1 * 8/2003 Kobe ..... A63B 49/08 128/849
7,749,572 B2 7/2010 Kitamura
9,622,526 B2 * 4/2017 Nakagawa ..... A41D 19/01558
2005/0268374 A1 * 12/2005 Mattesky ..... A41D 19/01523 2/164
2006/0150300 A1 * 7/2006 Hassan ..... A41D 19/0058 2/161.6
2008/0083050 A1 * 4/2008 Baker ..... A41D 19/0003 2/161.8
2008/0295219 A1 12/2008 Andersen et al.
2009/0007313 A1 * 1/2009 Boorsma ..... A41D 19/01505 2/161.8
2009/0126074 A1 * 5/2009 Mattesky ..... A41D 19/0065 2/161.8
2009/0139007 A1 * 6/2009 Bevier ..... A41D 19/01558 2/161.1
2009/0139011 A1 * 6/2009 VanErmen ..... A41D 19/01505 2/161.8
2010/0037364 A1 2/2010 Saunzdezrs et al.
2010/0071115 A1 3/2010 Sadato
2010/0275342 A1 * 11/2010 Sweeney ..... A41D 19/01505 2/167
2012/0058316 A1 * 3/2012 Cherneski ..... A41B 17/00 428/197
2012/0201321 A1 * 8/2012 Koivisto ..... H04B 7/0639 375/267
2012/0204321 A1 * 8/2012 Connelly ..... A41D 19/01582 2/161.6
2012/0227158 A1 * 9/2012 Ashworth ..... A41D 19/0065 2/164
2012/0288628 A1 * 11/2012 Nethsinghe ..... B29D 99/0067 427/277
2012/0324623 A1 * 12/2012 Cabauy ..... A41D 19/01558 2/167
2013/0281234 A1 * 10/2013 Ramirez ..... A41D 19/0013 473/415
2013/0291283 A1 * 11/2013 Hassan ..... A41D 19/0058 2/167
2013/0305430 A1 * 11/2013 Tomono ..... A41D 19/01558 2/163
2014/0041096 A1 * 2/2014 Takahashi ..... A41D 19/01558 2/168
2015/0143609 A1 5/2015 Francisco et al.
2015/0143610 A1 * 5/2015 Pimentel de Oliveira ..... A41D 19/01547 2/167
2016/0138215 A1 * 5/2016 O'Neill ..... D06M 15/19 2/168
2016/0262469 A1 * 9/2016 Fernando ..... A41D 19/0065

FOREIGN PATENT DOCUMENTS

JP 3132169 U 5/2007
JP 3164008 11/2010
JP 3164008 U 11/2010

OTHER PUBLICATIONS

International Search Report and Written Opinion dated Feb. 26, 2015 for PCT Application No. PCT/AU2014/001070.
Supplementary Partial European Search Report dated Oct. 18, 2017 for Application No. 14864429.

* cited by examiner

SUPPORTED GLOVE HAVING GRIP FEATURES

CROSS-REFERENCE TO RELATED APPLICATIONS

This application claims the benefit of U.S. Provisional Application No. 61/908,576 under 35 USC 119(e), filed Nov. 25, 2013, and is incorporated by reference in its entirety.

BACKGROUND

Field of the invention

Embodiments of the present invention generally relate to gloves and, more particularly, to supported gloves having an elastomeric, polymeric, or latex coating and raised elastomeric, polymeric, or latex features disposed on the coating, and a method of making the gloves.

Description of the Related Art

Gloves are utilized in many fields for protecting workers, such as medical, industrial, household, and others. In service, gloves are subjected to extensive wear from cuts, punctures, and abrasions, creating a need for durability. Furthermore, other in-service requirements include enhanced grip-ability, stretch-ability, and flexibility.

Some gloves include a fabric liner that is dipped into a rubber polymer (e.g., natural rubber latex, synthetic rubber latex, and the like) to form a coating that covers at least a portion of the fabric liner. However, such gloves do not offer adequate grip properties. Past attempts to impart better grip properties involved the use of caustic chemicals and many required many processing steps.

Furthermore, some gloves have a foamed polymeric coating to impart flexibility and other comfort-related properties. The foamed polymeric coating may be open-celled or closed-celled. Closed-celled foamed coatings maintain impervious properties, protecting against germs, viruses, and microbes, but typically have poor grip properties and are not quite as flexible as open-celled foamed coatings. Open-celled foamed coatings absorb moisture and oils better for enhanced grip, but do not adequately protect against germs, viruses, and microbes. Moreover, gloves having open-celled foamed coatings are not particularly abrasion resistant, leading to breaches during use and particularly during extended use.

Therefore, supported gloves offering enhanced grip properties and methods for producing supported gloves having enhanced grip properties represent advances in the art.

SUMMARY

A supported, coated liner having raised latex, elastomeric, or polymeric features disposed on the coating, and methods of making such gloves, in accordance with the present invention, substantially as shown in and/or described in connection with at least one of the figures, as set forth more completely in the claims, are disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation and that, where possible, identical reference numerals have been used to indicate comparable elements that are common to the figures.

DETAILED DESCRIPTION

Embodiments of the present invention comprise a fabric liner having a polymeric, elastomeric, or latex coating disposed thereon (forming a supported glove), and further comprising raised polymeric, elastomeric, or latex features, which comprise either or both of thermoplastic or thermoset materials, disposed on the coating, creating a glove having enhanced grip-ability. Methods for manufacturing the glove include knitting a fabric liner, dipping the knitted fabric liner into a polymeric, elastomeric, or latex composition to dispose a coating on at least a portion of the fabric liner, curing the polymeric, elastomeric, or latex coating, and disposing raised features, comprised of polymeric, elastomeric, or latex compositions, on the coating. Embodiments of the present invention include wherein the polymeric raised features are disposed on the polymeric coating before the curing step. As described below, embodiments according to the invention include where the coating comprises a polymeric composition and the raised features are comprised of a different polymeric composition.

Figure 1:
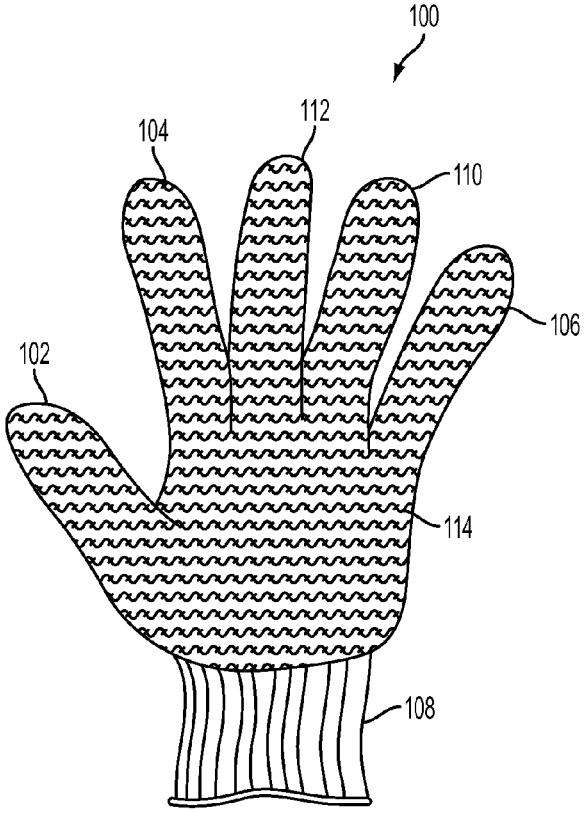
FIG. 1 depicts a fabric liner used in embodiments of the present invention.

FIG. 1 depicts a fabric liner used as a portion of embodiments of the present invention. A fabric liner 100, which is used as a portion of embodiments of the present invention, may be woven or knitted from one or more yarns. The fabric liner 100 has seven major components, including a pinky finger 106, a ring finger 110, a middle finger 112, an index finger 104, a thumb 102, a palm component 114, and a cuff 108. Embodiments of the invention include fingers, palm, and cuffs that are tapered for a tighter fit. Knitting machines, including those manufactured and commercialized by Shima Seiki, Mfg., Ltd., as discussed below, can be programmed to accommodate a large number of changes in stitch dimensions using varied stitch setups and to alter the physical dimensions used for the liner 100, i.e., specified for finger length and width, palm length and width, and overall glove or liner length and width and the like.

The fabric liner 100 may be woven or knitted from one or more yarns as discussed below, and may include one or more plaited layers. Fabric liners may be knitted by conventional knitting processes and comprise various yarns, deniers, and gauges. Fabric liners in accordance with embodiments of the invention may be knitted using automatic seamless glove knitting machines. Seamless glove knitting machines include, but are not limited to, models NSFG, NSFG-I, SFG-1, and SWG by Shima Seiki Mfg., Ltd, which may be used as fabric liners. Fabric liners knitted with the courses running vertically are knitted by the SWG (single whole garment) machine model, such technology being disclosed in commonly-assigned U.S. Provisional Application Ser. No. 61/735,881, filed Dec. 11, 2012, which is herein incorporated by reference in its entirety.

Fabric liners in accordance with embodiments of the invention comprise many different yarns and filaments to impart a variety of different properties to the fabric liners made therefrom. For example, cotton, wool, rayon, steel wire, glass fibers, filaments, ultra-high molecular weight polyethylene (UHMWPE), high-performance polyethylene (HPPE), such as DYNEEMA® and/or SPECTRA®, nylons, modacrylic yarns, oxidized-polyacrylonitrile (OPAN), meta-aramids, such as NOMEX®, para-aramids, such as KEVLAR® and/or TWARON®, aromatic polyesters, such as VECTRAN®, and the like, or any blend of these fibers and materials. Any yarn may comprise a blend of yarns, such as can be created by ring spun, rotor spun, friction spun, braiding, and other processes for blending yarns.

Some yarns may be used for cut-resistance, such as steel wire, glass fibers, filaments, ultra-high molecular weight polyethylene, NOMEX®, TWARON®, KEVLAR®, and DYNEEMA®. Other yarns provide dexterity and fit properties, such as stretchable yarns, for example, SPANDEX® and LYCRA®. Yarns capable of moisture management, such as STA-COOL® polyesters, HYDROTEC®, AQUARIUS®, and DRYENERGY®, may be included to withdraw moisture and perspiration from the skin, which also provide comfort. Furthermore, moisture and perspiration controlling yarns comprise antimicrobial agents, which are helpful in attenuating odors and/or preventing wounds and burns from becoming infected. Anti-microbial agents comprise surface coatings applied on the yarn, such as silane quaternary ammonium and/or N-Halamine compounds, TRICLOSAN®, as well as elemental silver and silver-releasing compounds.

Also, some yarns, for example, OPAN, such as PANOX®, and ARSELON®, provide enhanced flame- and/or heat-resistance. Also, some yarns may be plaited to create a liner having two or more layers. For example, a cut resistant yarn such as one or more of steel wire, glass fibers, filaments, ultra-high molecular weight polyethylene, nylons, NOMEX®, TWARON®, KEVLAR®, DYNEEMA®, SPECTRA®, VECTRAN®, and the like or any blend of these fibers and materials, may have an OPAN yarn or cotton fiber plaited therewith.

In at least one exemplary embodiment of the present invention, the fabric liner 100 is a 13-gauge knitted liner comprising an aliphatic or aromatic nylon, an elastic fiber, fiberglass, and a cut-resistant yarn. In some embodiments of the present invention, the aliphatic nylon is nylon 66 and the aromatic nylon is an m-aramid, such as NOMEX® or a para-aramid, such as KEVLAR®, the elastic fiber is LYCRA®, and the cut-resistant yarn is an ultra-high molecular weight polyethylene fiber, such as DYNEEMA®. In some embodiments of the invention, the fabric liner 100 may be knitted using at least one 15-gauge or 18-gauge needle, allowing the use of finer yarns.

Figure 2:
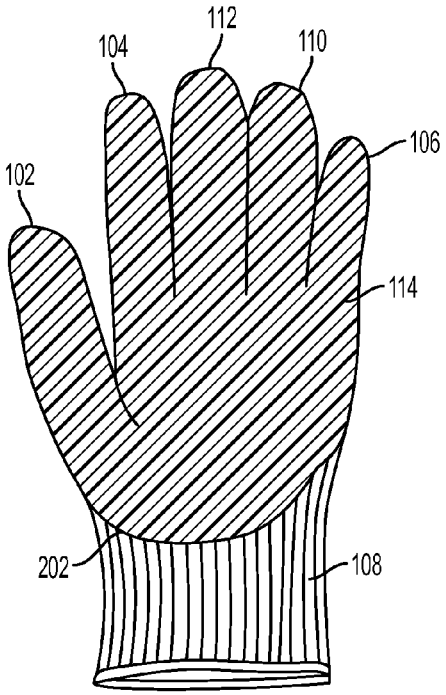
FIG. 2 depicts a fabric liner having a polymeric coating disposed thereon according to embodiments of the invention.

FIG. 2 depicts a fabric liner having a polymeric coating 202 disposed thereon according to embodiments of the invention. The fabric liner 100 has a polymeric coating 202 disposed on the palm side of the thumb 102, fingers 104, 112, 110, 106, and the palm component 114. In some embodiments, the polymeric coating 202 is disposed as a palm-dip, a three-quarters dip, or a full dip, and/or other dips as is known to those in the art. The polymeric coating 202 comprises one or more polymeric materials or blends thereof, including thermoplastic and thermoset materials, as discussed below. Thermosetting materials may include, for example, phenolics, silicones, polyesters, and sulfur-filled (or other vulcanizing agents), vulcanizable natural and synthetic rubber materials. The inclusion of thickening agents known to those in the art to control the viscosity of the thermosetting materials is also contemplated herein.

Gloves according to the invention comprise natural or synthetic polymeric coatings or compositions, mixtures, or blends thereof. For example, a polymeric coating made from a composition may comprise a natural latex, such as guayule or natural polyisoprene, synthetic latexes, such as synthetic polyisoprene, carboxylated acrylonitrile butadiene, non-carboxylated acrylonitrile butadiene, butyl latex, polychloroprene, nitriles, aqueous- and non-aqueous-polyurethanes, styrene-butadiene, and the like, or mixtures or blends thereof. Similarly, the raised features, such as the raised features 204 discussed below, disposed on the polymeric coating 202 comprise polymeric compositions, for example, thermoset or thermoplastic dispersions, solutions, and/or emulsions, and/or blends thereof. Embodiments of the invention include a polymeric coating 202 having different grip properties than the raised features disposed thereon, as discussed below. For example, in at least one exemplary embodiment of the present invention, the polymeric coating 202 comprises a highly-carboxylated acrylonitrile-butadiene material and the raised features disposed thereon further comprise an aqueous polyurethane material and/or vice-versa. A highly-carboxylated acrylonitrile-butadiene in this context indicates approximately 35-40% acrylonitrile, and is particularly oil-resistant.

The temperature of the polymeric compositions may be controlled, as is known in the art, and may include additives, such as surfactants, to control or modify the physical properties of the polymeric compositions and/or resulting article formed thereby. The polymeric compositions also comprise various accelerants, stabilizers, pigments, and other components such as anti-microbial agents, fillers/additives, and the like. In some embodiments, the polymeric compositions comprise additives, such as bentonite and other clays, minerals, silica, and/or like thickeners, to control the rheological properties of the polymeric compositions. The polymeric composition of one or more embodiments may also include a cure package or vulcanization agents to promote cross-linking during the curing process, such as sulfur and/or other suitable crosslinking agents and activators, such as zinc oxide, known to those in the art. The polymeric compositions for the coatings made therefrom often have a viscosity in the range of 250-5000 centipoises (cP) and have commonly used stabilizers including but not limited to potassium hydroxide, ammonia, sulfonates, and others known to those of skill in the art. In at least one exemplary embodiment, the viscosity of the polymeric compositions for the raised features ranges from approximately 1000 cP to 40000 cP.

Figure 3:
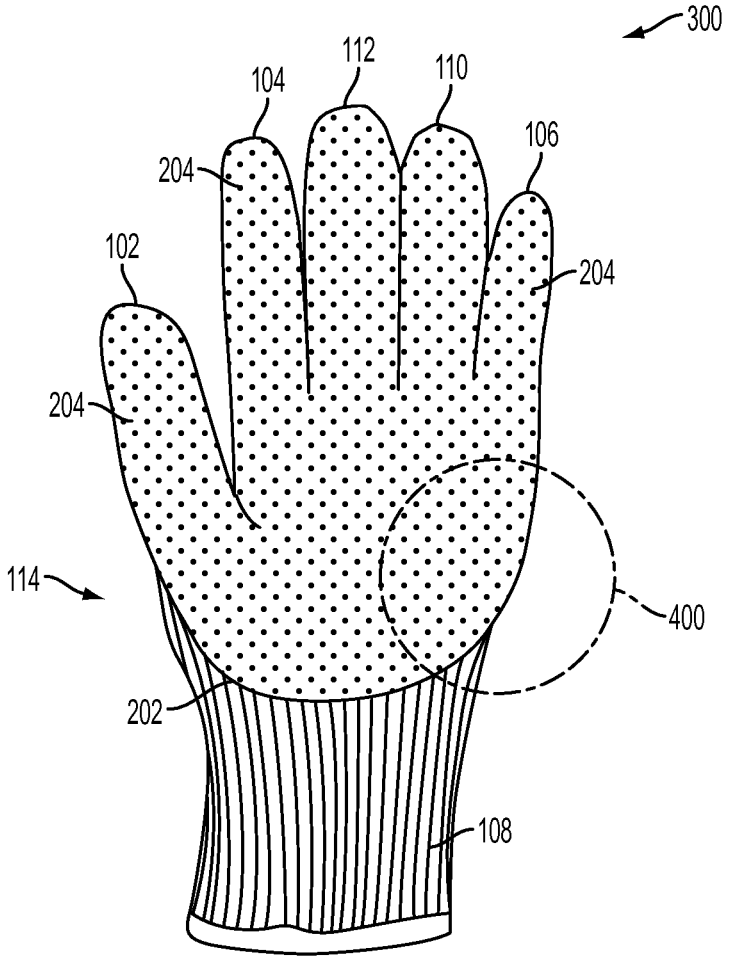
FIG. 3 depicts an exemplary coated glove showing the palm-side of the glove having raised features disposed thereon, according to embodiments of the present invention.

FIG. 3 depicts an exemplary coated glove showing the palm-side of a glove having raised features disposed thereon, according to embodiments of the present invention.

The glove 300 comprises, for example, the fabric liner 100 having the polymeric coating 202 disposed thereon and further comprising a plurality of raised features 204 disposed on the coating. At least one exemplary embodiment of the present invention includes the polymeric coating 202 formed of a nitrile-butadiene composition and the raised features 204 disposed thereon comprising a polyurethane composition, which could be an aqueous or non-aqueous or solvent based polyurethane composition or a polyurethane-polyurea composition. In some embodiments, the polymeric coating 202 is formed of a polyurethane composition while the raised features 204 comprise a nitrile-butadiene composition. Embodiments of the invention include wherein the polymeric coating 202 and the raised features 204 are of two different two polymeric compositions such that each has different grip properties. For example, polyurethane compositions offer excellent wet and/or oily grip properties while nitrile butadiene compositions offer excellent dry grip properties.

One exemplary formulation for a carboxylated nitrile-butadiene composition, according to embodiments, for coatings is shown in Table 1.

TABLE 1

| Ingredient | % in formulation |
|---|---|
| Dispersion of nitrile-butadiene polymer | 75-95 |
| Surfactant | 0-1 |
| Colorant/Pigment | 0.1-5 |
| Vulcanization agent(s) | 2-7 |
| Various additives | 0-7 |
| Thickener(s)/Rheology modifier(s) | 0.1-5 |

One exemplary formulation for a polyurethane composition, according to embodiments, for raised features disposed on the coatings, is shown in Table 2.

TABLE 2

| Ingredient | % in formulation |
|---|---|
| Dispersion of polyurethane polymer | 90-100 |
| Colorant/Pigment | 0-5 |
| Various additives | 0-3 |
| Thickener(s)/Rheology modifier(s) | 0-5 |

At least one acrylic composition, according to embodiments of the invention, for raised features disposed on the coatings, is shown in Table 3. And, one exemplary composition comprises acrylic grade Polidisp 7730, manufactured by the Resiquimica Co. Embodiments according to the invention further comprise pressure sensitive acrylic formulations as are known to those in the art.

TABLE 3

| Ingredient | % in formulation |
|---|---|
| Dispersion of acrylic polymer | 90-100 |
| Colorant/Pigment | 0-5 |
| Crosslinker | 1-3 |
| Various additives | 0-3 |
| Thickener(s)/Rheology modifier(s) | 0-5 |

We have surprisingly found that raised polyurethane features have much greater grip properties than some other polymeric materials for use as raised features, e.g., dots, rings, etc., described below, for some in-service applications. For example, nitrile-butadiene rubbers offer good grip properties for dry in-service requirements while polyurethanes offer good grip properties for wet and oily environments. Therefore, a glove comprising a coating of, for example, nitrile-butadiene and having polyurethane features disposed on the coating surface, or vice-versa, i.e., polyurethane coating having nitrile raised features disposed thereon, can be used in both dry and wet/oily environments. Therefore, a user need not re-glove or even have two different types of gloves because one glove, according to embodiments of the invention, will fulfill the needs of all types. A glove manufactured with a foamed nitrile-butadiene coating and raised features comprising polyurethane, as indicated above, increased the coefficient of friction in dry, water, and oily environments by 64%, 140% and 50% respectively, compared with a glove without PU raised dots. Also, in addition to using polyurethane materials for raised dots, rings, etc., acrylics, as is shown in Table 3 above, and/or poly(vinyl chloride) materials also may be disposed on nitrile-butadiene coatings. These materials also provide enhanced grip properties.

As shown in FIG. 3, the raised features 204 are round, raised dots. In embodiments according to the present invention, the round, raised dots have a thickness between 1.0 to 2.0 mm. The diameter of the round raised dots range from approximately 1 to 10 mm in diameter. However, any practical shape, such as hexagonal, size, and number of raised features 204 may be disposed on the coating 202. FIG. 3 also shows cutaway view 400.

Figure 4A:
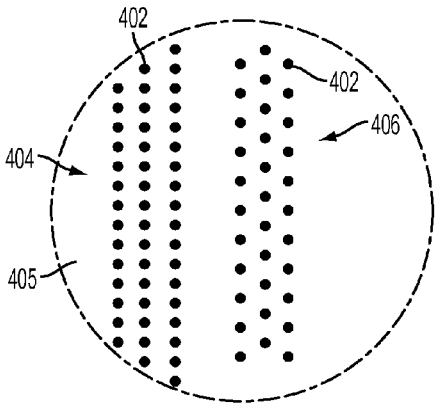
FIGS. 4A-4F depict in cutaway views, various alternative embodiments of raised features disposed on the glove of FIG. 3 as shown in cutaway view, according to embodiments of the invention.
Figure 4B:
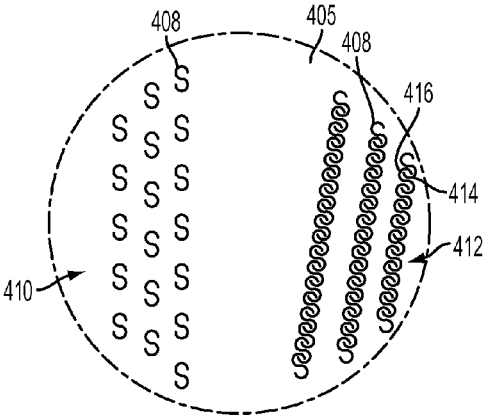

FIGS. 4A-4F depict in cutaway views, various embodiments of raised features disposed on the glove of FIG. 3 as shown in the cutaway view 400, according to embodiments of the invention. As discussed above, different patterns of the raised features may impart different grip properties, such as for dry, wet, or oily service requirements. For example, FIG. 4A shows two separate embodiments of patterns of raised features comprising a polymeric composition and disposed on a polymeric coating. The raised dots 402, as shown, are small but may be as large as is practical. A feature 405 is the underlying coating layer described above. In the pattern 404, the raised dots 402 are disposed in single file laterally and longitudinally. In a pattern 406, the raised dots 402 are disposed in a staggered pattern. In FIG. 4B, the raised features comprise an S-shaped raised feature 408. The S-shaped raised feature 408 may be in a staggered pattern 410 or in a single file (not shown). Also, as shown in a pattern 412, ends 414 and 416 of adjacent S-shaped raised feature 408 may form an interlocked structure. In some embodiments, the wave-like feature assumes a "C" structure.

Figure 4C:
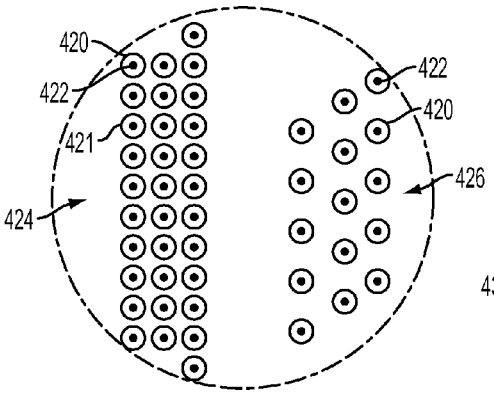
Figure 4D:
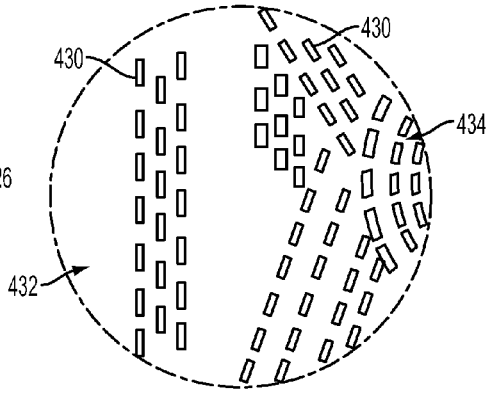
Figure 4E:
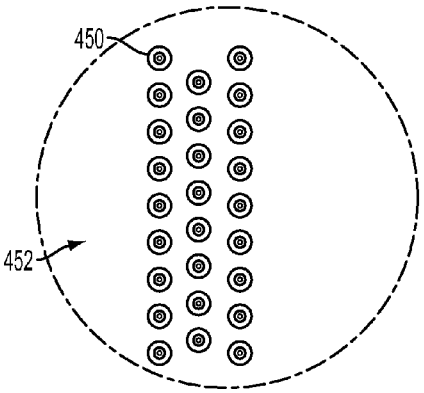
Figure 4F:
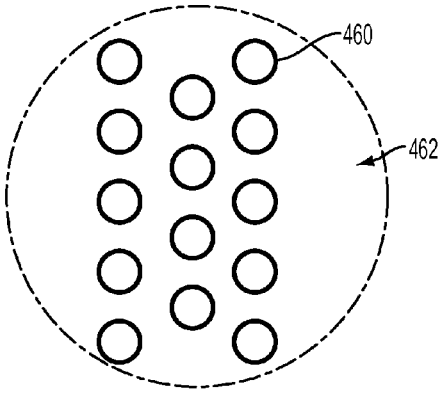

FIG. 4C shows patterns of raised features 420 and 422. A ring 420 is a raised circular rail that surrounds a raised dot 422, i.e., a nipple. A feature 421 is the coating layer applied as above and, therefore, it is recessed from the raised ring 420 and the raised dot 422. As above, the raised features may be disposed in a single file pattern 424 or in a staggered pattern 426. FIG. 4D depicts the raised features as rectangular raised rails 430 in a staggered pattern 432. Embodiments according to the invention also comprise where rectangular raised rails 430 are disposed in a grain pattern 434, i.e., where several straight or curved patterns of rectangular raised rails 430 intersect, i.e., the appearance of wood grain. FIG. 4E depicts small thicker rings 450 arranged in a staggered pattern 452. FIG. 4F depicts large thinner rings 460 arranged in a staggered pattern 462. Any glove described herein comprises any or all of the raised features of FIGS. 4A-4F. In other words, a glove may comprise raised dots, rings, S-shaped features, etc., on the same glove.

Figure 5:
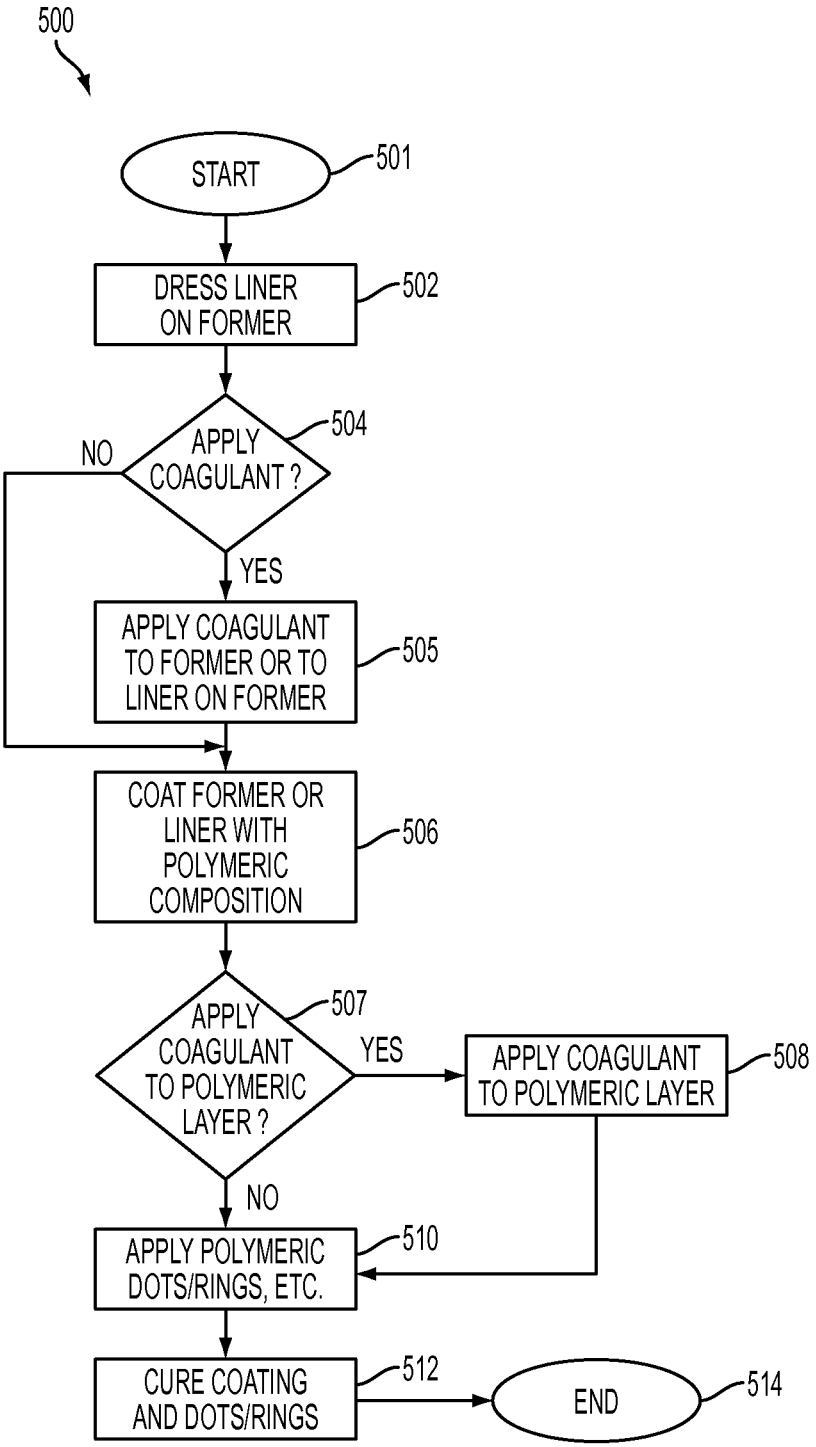
FIG. 5 is an exemplary flow diagram of a method for making a glove according to embodiments of the present invention.

FIG. 5 is an exemplary flow diagram of a method for making a glove according to embodiments of the present invention. Method 500 starts at step 501 and proceeds to step 502, at which point a fabric liner is dressed onto a former. Method 500 proceeds to step 504, at which point a decision is made whether to apply a coagulant to the fabric liner. If the answer is yes, at step 505, a coagulant (as discussed below) is applied to the liner, which may comprise a dipping, spraying, or other process step, such as a silk-screening or air-jet process. In some embodiments of the invention, the coagulant is applied to the liner before the liner is dressed on a former.

At step 506, the liner is dipped into a polymeric composition, forming a polymeric coating on the fabric liner. In some embodiments, the liner is dipped into the polymeric composition to cover a portion of the liner, such as a palm dip or three-quarters dip (in which parts of the backhand side of the liner are not fully covered with a coating). In some embodiments, the entire liner is dipped, e.g., a "full" dip.

At step 507, a decision is made whether to apply a coagulant to the polymeric coating, causing a hardening of the coating, which may be accomplished by spraying or dipping. If the answer is yes, proceeds to step 508, at which point a coagulant is applied and then method 500 proceeds to step 510. If the answer is no, the method 500 proceeds to directly to step 510. Also, other finishing processes may be applied at this stage. For example, the coating and/or raised features may be cured by the application of heat. Moreover, salt-texturization or wrinkling processes may be added to the process, as are known to those in the art, to provide enhanced grip properties.

At step 510, dots, rings, waves, grains, or other raised features, comprising a polymeric composition, are applied onto the polymeric coating. In some embodiments, the polymeric composition applied at step 506 is the same as the composition as the polymeric composition applied at step 510. In some embodiments, the polymeric composition applied at step 510 and 506 are different. Also, in some embodiments, the raised features, comprising a polymeric composition, may be disposed on the polymeric coating by spraying, air-jetting, 3D-printing, or silkscreen-printing. A silkscreen printing process allows the plurality of raised features to be applied in many different sizes, shapes, or patterns, as disclosed above. At least one exemplary embodiment includes wherein the silkscreen is a stainless steel screen. In some embodiments, the fabric liners are dressed on an arcuate, glove-shaped former, stripped from the arcuate glove-shaped former, and dressed onto a flat former for screen-printing. The polymeric coating may be cured prior to stripping the fabric liner/polymeric coating from the glove-shaped former. In some embodiments, the temperature of the polymeric composition during the screen-printing step is between 10-30° C. and, in at least one embodiment according to the invention, the temperature is approximately 23-25° C. Other processes for disposing polymeric raised features on the polymeric coating of the glove include 3-D printing methods.

The method 500 then proceeds to step 512, at which point, both the polymeric coating and the polymeric raised features applied at step 510 are cured in an oven at, for example, 50° C. to 150° C. for approximately 10 to 120 minutes. In at least one exemplary embodiment of the invention, made from the foregoing method, gloves having the raised features disposed thereon are placed into an oven, for example, an infrared oven and heated to approximately 105° C. to 130° C. for approximately 5 to 30 minutes, forming a cured glove. In at least one embodiment according to the invention, curing is for approximately 7-8 minutes at 130° C. or, for example, 20 minutes at approximately 115° C. The method 500 then proceeds to step 514, at which point the method 500 ends. In some embodiments of the present invention, the heating or curing occurs twice—once before the raised features are disposed on the polymeric coating and once after the raised features are disposed thereon.

Some steps of the preceding method 500 may be omitted or performed in a different sequence. Moreover, raised steps may be employed. For example, the liner having the coating thereon may be cured before the addition of the raised features. Also, the glove may be stripped from the former, washed, and dried following step 506. Washing can be carried out at a temperature between approximately 25° C. and 60° C., for approximately 15 to 90 minutes. The gloves are then dried in a tumble dryer for approximately 20 to 60 minutes at 50° C. to 70° C. These ranges allow different moisture contents, which may be important for the subsequent steps, for example, re-dressing the gloves on former and adding the raised features at step 510.

The manufacturing process for a flexible polymeric coated glove involves several steps. In embodiments of the present invention, a knitted fabric liner, for example, a 10-, 13-, 15-, or 18-gauge liner, comprising, for example, a nylon filament, a LYCRA® filament, glass fibers, and DYNEEMA® is dressed on a hand shaped ceramic or metallic former and is immersed in, for example, a weak coagulant, such as a 1-20% wt. aqueous solution of acetic acid, formic acid, or tricarboxylic acid. The coagulant solution penetrates substantially all of the entire thickness of the fabric liner. When the coagulant coated liner contacts aqueous polymeric composition, it destabilizes the composition and gels the latex. Because the coagulant increases the gelling action of the elastomeric, polymeric, or latex composition, the ingress of the elastomeric, polymeric, or latex composition into the interstices of the liner is impeded, thereby substantially preventing the entire penetration of the elastomeric, polymeric, or latex composition into the thickness of the knitted liner, preventing "strike-through," which results in an uncomfortable glove having a clammy feel. The composition gels due to the action of the coagulant resident on the surfaces of the yarns, forming chocking regions between the fibers preventing further entry of the composition into the knitted fabric liner. Other suitable coagulants include, but are not limited to, strong coagulants, such as calcium nitrate, calcium chloride, calcium citrate, and the like, and other salts known to those in the art. The knitted liner, containing a coagulant and dressed on the former, is next dipped in the elastomeric, polymeric, or latex composition, emulsion, dispersion, or solution.

Embodiments according to the present invention further comprise a foamed elastomeric, polymeric, or latex composition. The air content is typically in the 5 to 50% range on a volume basis. The elastomeric, polymeric, or latex composition may contain raised surfactants such as TWEEN 20 to stabilize the foamed composition. Once the composition is foamed with the desired air content and the viscosity is adjusted, refinement of the foamed composition is undertaken by stirring the composition with an impeller driven at a fast speed and using a different impeller run at a reduced speed to refine the bubble size as is known to those of skill in the art. Methods for incorporating high air contents are described in Woodford et al., U.S. Pat. No. 7,048,884, which is commonly-assigned and incorporated herein in its entirety.

Foamed elastomeric, polymeric, or latex compositions having a higher viscosity do not penetrate the interstices between the yarns in the knitted liner and may require a higher depth of immersion of the former having the dressed knitted liner. Also, the air cells reduce the modulus of elasticity of the coating made from the elastomeric, polymeric, or latex composition, increasing the flexibility of the glove. The air content in the range of 5-15 volumetric percent results in foams that have closed cells, creating a foamed coating that is liquid impervious and has a spongy, soft feel.

Some air cells, whether an open-celled or close-celled foam are disposed on the external surface of the coating, providing increased roughness and have the ability to remove boundary layer of oil and water from a gripping surface, providing increased grip properties. If the volumetric air content is in the range of 15-50% in a foamed coating on a liner, the air cells are adjacent to each other and expand during a vulcanization heating step and touch each other, and merge. This process creates an open-celled foam having an intra-foam network of cells in fluid communication with each other. Therefore, open-celled foams absorb liquids into an internal matrix. For example, if a drop of liquid is placed on a glove in the palm portion, the liquid penetrates the polymeric coating cells, as opposed to a closed-celled foam, which is impervious to liquids. Without intending to be bound by theory, it is similarly believed that a polymeric, open-celled foam disposed as a coating on a liner allows the raised features disposed on the coating, as discussed below, to penetrate the internal cell matrix of the coating, forming a glove comprising more abrasion-resistant raised features that do not peel from the coating as readily. Moreover, the surface tension of the composition comprising the raised features can be varied to promote adherence to the foamed coating.

The process according to embodiments of the invention further comprises the step of dipping the fabric liner having a polymeric coating disposed thereon into a coagulant, either or both of before or after the raised features are disposed thereon. In some embodiments, the coated glove has a weak acid applied thereto, optionally followed by the application of a strong coagulant, as described in commonly-assigned patent application Ser. No. 13/928,615, which is herein incorporated by reference in its entirety. Without intending to be bound by theory, it is believed that first applying a weak acid gels the outer surface slowly, which allows the interior of the polymeric layer to receive the coagulant. Because the interior as well as the surface gels, the coating is not case hardened, as is the case with the application of a strong coagulant and is gelled more completely throughout the layer, and is therefore more abrasion-resistant.

Abrasion resistance and grip properties, such as dynamic and static coefficient of friction in different environments, such as wet, dry, oily of various gloves according to embodiments of the invention exhibit vastly increased performance over prior art gloves. This phenomenon is true irrespective of whether the raised features are disposed on the coating as toroids, dots, bullets, small rings, big rings, waves, or grains.

Grip performance. In some embodiments, the dry coefficient of friction for polyurethane raised features was as high as 1.239. In some embodiments, the wet coefficient of friction was as high as 1.159. In some embodiments, the oil coefficient of friction was as high as 0.762. Without intending to be bound by theory, it is believed that one explanation for the increased grip performance is that when pulling forces reach a certain threshold, dragging is overcome and a sample is moved easier. This causes a drop in pulling and, consequently, the sample starts a new increase of resistance to movement. In other words, there is a build-up and drop of the drag.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in any one or more of the embodiments. Also, it is to be understood that polymeric, elastomeric, and latex are used interchangeably herein with respect to polymeric coatings and raised features made from polymeric compositions.

While the foregoing is directed to embodiments of the present invention, other and further embodiments of the invention may be devised without departing from the basic scope thereof, and the scope thereof is determined by the claims that follow.

What is claimed is:

1. A glove comprising:

a fabric liner;

a first foamed polymeric composition comprising one of nitrile-butadiene or polyurethane adhered to at least a portion of the fabric liner, forming a foamed polymeric coating having an exterior surface; and a plurality of raised features comprising one of a nitrile-butadiene or polyurethane polymeric composition disposed on the exterior surface of the foamed polymeric coating, wherein the foamed polymeric coating and the plurality of raised features comprise different polymeric compositions adapted to enhance at least one of oil grip properties, dry grip properties, or wet grip properties.

2. The glove of claim 1, wherein the plurality of raised features comprises polyurethane for enhancing good wet and oil grip properties and the first foamed polymeric coating comprises nitrile-butadiene for enhancing good dry grip properties.

3. The glove of claim 1, wherein the first foamed polymeric coating comprises polyurethane and the plurality of raised features comprise nitrile-butadiene, wherein the first foamed polymeric coating has enhanced good wet and oily grip properties and the plurality of raised features has enhanced good dry grip properties.

4. The glove of claim 1, wherein the thickness of the plurality of raised features ranges from 1 to 2 mm.

5. The glove of claim 1, wherein the raised features are disposed on at least one of a finger, a fingertip, a thumb, a thumb tip, or a palm.

6. The glove of claim 1, wherein the raised features are at least one of S-shapes, interlocking S-shapes, interlocking U-shapes, dots, bar-shapes, rail-shapes, ring-shapes, or nipple-shapes.

7. The glove of claim 1, wherein the fabric liner comprises at least one of cotton, wool, rayon, steel wire, glass fibers, ultra-high molecular weight polyethylene, high-performance polyethylene, nylon 6, nylon 66, modacrylic, meta-aramid, or para-aramid yarns or blends thereof.

8. The glove of claim 1, wherein the first foamed polymeric composition is an open-celled foam composition.

9. The glove of claim 1, wherein the wherein the nitrile-butadiene or polyurethane polymeric composition disposed on the exterior surface of the foamed polymeric coating is a foamed composition.

10. The glove of claim 1, wherein the first foamed polymeric composition has a close-celled foam structure.

11. A glove comprising:

a fabric liner;

a first polymeric composition adhered to at least a portion of the fabric liner, forming a polymeric coating having an exterior surface, wherein the first polymeric composition comprises nitrile-butadiene; and a plurality of raised features comprising polyurethane disposed on the exterior surface of the polymeric coating, wherein the polymeric coating and the plurality of raised features comprise different polymeric compositions, wherein the plurality of raised features comprising polyurethane enhance wet and oil grip properties and the first polymeric composition comprising nitrile-butadiene enhance good dry grip properties.

12. A glove comprising:

a fabric liner;

a first polymeric composition comprising butadiene and acrylonitrile adhered to at least a portion of the fabric liner, forming a carboxylated acrylonitrile-butadiene polymeric coating having an exterior surface, wherein the acrylonitrile is present in an amount of approximately 35 to 40 percent by weight of the first polymeric composition; and a plurality of raised features comprising a polyurethane polymeric composition disposed on the exterior surface, wherein the carboxylated acrylonitrile-butadiene polymeric coating is oil-resistant.

13. The glove of claim 12, wherein the carboxylated acrylonitrile-butadiene polymeric coating is foamed.

* * * * *